US010434815B2

(12) United States Patent
Cheon

(10) Patent No.: US 10,434,815 B2
(45) Date of Patent: Oct. 8, 2019

(54) SLIDE-TYPE WRITING INSTRUMENT HAVING DRYING-PREVENTION DEVICE

(71) Applicant: Kwang Ju Cheon, Kyunggi-do (KR)

(72) Inventor: Kwang Ju Cheon, Kyunggi-do (KR)

( * ) Notice: Subject to any disclaimer, the term of this patent is extended or adjusted under 35 U.S.C. 154(b) by 0 days.

(21) Appl. No.: 16/028,226

(22) Filed: Jul. 5, 2018

(65) Prior Publication Data

US 2019/0016173 A1 Jan. 17, 2019

(30) Foreign Application Priority Data

Jul. 11, 2017 (KR) ..... 10-2017-0087732

(51) Int. Cl.

| | |
|---|---|
| ***B43K 8/24*** | (2006.01) |
| ***B43K 24/08*** | (2006.01) |
| ***B43K 8/02*** | (2006.01) |
| *B43K 8/00* | (2006.01) |
| *B43K 5/17* | (2006.01) |
| *B43K 5/00* | (2006.01) |

(52) U.S. Cl.

CPC ..... *B43K 8/24* (2013.01); *B43K 8/028* (2013.01); *B43K 24/08* (2013.01); *B43K 5/005* (2013.01); *B43K 5/17* (2013.01); *B43K 8/003* (2013.01)

(58) Field of Classification Search

CPC ..... B43K 8/24; B43K 8/028; B43K 8/003; B43K 24/08; B43K 25/028; B43K 5/005; B43K 5/17

See application file for complete search history.

(56) References Cited

U.S. PATENT DOCUMENTS

| | | | | |
|---|---|---|---|---|
| 3,292,593 A * | 12/1966 | Furuya | B43K 5/17 401/107 |
| 3,362,778 A * | 1/1968 | Pavese | B43K 5/17 401/107 |
| 3,525,573 A * | 8/1970 | Fend | B43K 7/12 401/108 |
| 4,560,298 A * | 12/1985 | Oki | B43K 5/17 401/107 |
| 6,981,812 B1 * | 1/2006 | Hsieh | B43K 8/028 401/107 |

(Continued)

FOREIGN PATENT DOCUMENTS

| | | |
|---|---|---|
| KR | 2019880002221 | 4/1988 |
| KR | 1019880006058 | 7/1988 |
| KR | 1014559580000 | 10/2014 |

*Primary Examiner* — J C Jacyna

(74) *Attorney, Agent, or Firm* — IPLA P.A.; James E. Bame

(57) ABSTRACT

A slide-type writing instrument having a drying-prevention device. The slide-type writing instrument includes a pen housing (10); a button clip part (20); an ink holder (30) having a cam protrusion (70); a sealing member (40) including a cover (41) and a fixing cap (45); a spring member (50); and a guide member (60) configured to guide the cover (41). The sealing member (40) includes an inner soft tube (40*a*) formed of a soft material and in the shape of a hollow tube, and an outer hard tube (40*b*) formed of a hard material and in the shape of a hollow tube and externally surrounding the soft tube (40*a*). The soft tube (40*a*) and the hard tube (40*b*) are coupled to each other to form a dual cross-section structure, and a lower end of the soft tube (40*a*) further extends than a lower end of the hard tube (40*b*).

2 Claims, 6 Drawing Sheets

(56) References Cited

U.S. PATENT DOCUMENTS

| | | | | |
|---|---|---|---|---|
| 2007/0041775 | A1* | 2/2007 | Lammers | B43K 8/003 401/107 |
| 2010/0322697 | A1* | 12/2010 | Rolion | B43K 8/028 401/107 |
| 2015/0147106 | A1* | 5/2015 | Hashimoto | B43K 23/08 401/108 |
| 2015/0224812 | A1* | 8/2015 | Cheon | B43K 8/03 401/104 |
| 2018/0056706 | A1* | 3/2018 | Ballot | A46B 11/001 |
| 2018/0215193 | A1* | 8/2018 | Yoon | B43K 24/08 |

* cited by examiner

SLIDE-TYPE WRITING INSTRUMENT HAVING DRYING-PREVENTION DEVICE

BACKGROUND

The present invention relates to a slide-type writing instrument having a drying-prevention device, and more particularly, to a slide-type writing instrument having a drying-prevention device, wherein the sealing ability and durability of a sealing member are greatly improved to consistently prevent evaporation of ink or drying of a pen tip of the writing instrument using highly-volatile ink, such as a highlighter, a marker, a magic marker, a plus pen or the like.

In general, writing instruments refer to magic markers, highlighters, markers or the like in addition to ballpoint pens, and most of them are provided with detachable sealing caps for preventing ink from being dried at pen tips of the writing instruments.

These writing instruments may be largely classified into a fixed-type writing instrument employing a fixed pen tip and a cap (also referred to as "lid"), a rotation-type (screw-type) writing instrument in which a portion of a pen tip is come out along a spiral pipe by partially rotating a shaft, a knock-type writing instrument in which a pen tip comes out by a movement of a spring in response to pressing of a portion of a shaft, and a slide-type writing instrument in which a pen tip is slid to come in and out.

A sealing member of the slide-type writing instrument has an advantage in that a user can use the writing instrument without any inconvenience related to opening and closing of a separate lid. However, this sealing member has a disadvantage that since it is simply a pen tip-passing hole through which a pen tip comes in and out and which is provided at a one end of the writing instrument, this sealing member is limitedly applicable only to writing instruments using non-volatile or low-volatile ink such as oil-based ink or the like.

On the contrary, when pen tips of marker pens, white pens, water-based pens, highlighters or the like using highly-volatile ink remain in air for a long time, ink or the like is dried, whereby the useful life of the writing instruments may be shortened or deteriorated. Therefore, although there is inconvenience in use, lids are opened and closed to use the writing instruments.

Accordingly, Korean Publication Patent No. 10-1995-0000776 (Lidless writing instrument having drying-prevention device) discloses a configuration in which when a pressing portion of a slide-type writing instrument is pressed, a cover for covering a pen tip portion is opened, and when the pressing portion is pressed once again, the cover is closed and seals the writing instrument to prevent drying of ink.

In addition, Korean Utility Model Registration No. 20-1989-0003644 (Capless writing instrument) discloses a configuration in which when a knock portion is pressed, a pen tip breaks through an elastic body provided on an inner barrel and then is exposed to allow a pen to be used, and when the pen tip is returned to its original position by releasing or re-pressing the knock portion, incised portions of the elastic body are brought into contact with each other and then closed, thereby preventing the pen tip from being dried.

However, this configuration has disadvantages in that the incised portions of the elastic body may be plastically deformed due to friction caused by frequent uses and a sealing force is also deteriorated due to frequent friction.

Meanwhile, the invention disclosed in Korean Patent No. 10-1455958 was conceived by the present inventor and granted as a patent. The patent proposes a slide-type writing instrument having a drying-prevention device, wherein when a knob is simply pressed, a cover portion for sealing a pen tip is opened so that the pen tip protrudes, whereas when the knob is released, the pen tip is retreated into an interior of the writing instrument and the cover portion is automatically closed to prevent the pen tip accommodated in the interior of the writing instrument from being dried.

For the drying-prevention function of such a writing instrument, the performance and durability of the sealing member that is opened or closed in response to an operation of causing the pen tip to come in or out and maintains airtightness in a state where the pent tip is accommodated inside are very critical.

However, the invention disclosed in Korean Patent No. 10-1455958, which was conceived by the present inventor and granted as a patent, was considered to have a limitation on maintaining a precise airtight state between a circular end of a sealing member and a cover hingedly connected thereto.

At the beginning of use, there was no great problem in maintaining a sealing performance between the circular end of the sealing member and the cover. However, there were disadvantages in that when the writing instrument is repeatedly used, a minute gap is formed at a position where the cover is in contact with the end of the cylindrical sealing member, which results in loss of airtightness and gradual deterioration of the sealing performance. Particularly, as for marker pens, white pens, water-based pens, highlighters pens, and the like, which use highly-volatile ink, when these writing instruments are left for a long time, there is concern about a phenomenon in which a volatile component escapes to the outside through the minute gap so that ink or the like is dried up may occur.

SUMMARY OF THE INVENTION

It is an object of the present invention to provide a slide-type writing instrument wherein a sealing member of the slide-type writing instrument is improved to prevent loss of a sealing function or occurrence of a failure, which is caused by repeated uses, and to significantly improve the reliability and durability of a product.

In order to achieve the object, the present invention further improves a sealing member of a slide-type writing instrument while employing existing other components themselves except for the sealing member.

In one aspect, the present invention provides a slide-type writing instrument having a drying-prevention device, including a pen housing formed in a hollow cylindrical shape and having a pen tip-passing hole formed at a leading end of the pen housing and a button clip part at an upper end of the pen housing; an ink holder disposed in the pen housing and containing ink therein; a sealing member comprising a cover configured to open or close the pen tip-passing hole in response to a forward or rearward movement of the ink holder so that the pen tip may come in and out through the pen tip-passing hole, and a fixing cap configured to be caught on a stepped portion formed on an inner side of the pen housing; a spring configured to elastically support the sealing member and the ink holder; a guide member made of a synthetic resin and disposed between the sealing member and the pen housing, wherein when the ink holder is moved forward or rearward, the guide member guides the cover of the sealing member into a state where the cover is fitted into a cam slit of the guide member, so as to guide an opening or closing operation of the cover; and a cam protrusion formed on the ink holder and configured to move the guide member while being in contact with engagement parts of the guide member.

Here, the sealing member includes an inner soft tube formed of a soft material and in the shape of a hollow tube, and an outer hard tube formed of a hard material and in the shape of a hollow tube and externally surrounding the soft tube. The soft tube and the hard tube are coupled to each other to form a dual cross-section structure, and a lower end of the soft tube further extends than a lower end of the hard tube by a protruding height t so that a portion of the lower end of the soft tube, which is circumferentially defined by the protruding height t, forms a closed ring-shaped portion.

Preferably, protrusions are formed to protrude at an upper end of an outer surface of the soft tube; a fixing cap is formed at an upper end of an outer surface of the soft tube and receiving recesses are formed in the fixing cap; and the soft tube and the hard tube are assembled by interference-fitting the protrusions of the soft tube into the receiving recesses of the hard tube.

DETAILED DESCRIPTION OF THE INVENTION

Figure 1:
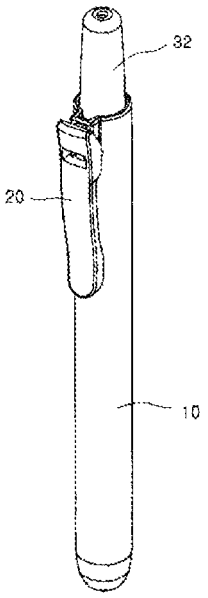
FIG. 1 is a perspective view showing a state where a pen tip of a writing instrument according to the present invention is stored in a pen housing of the writing instrument and thus maintained in an airtight condition.
Figure 2:
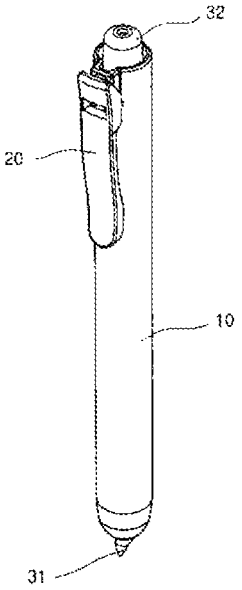
FIG. 2 is a perspective view showing a state where the pen tip of the writing instrument according to the present invention is exposed.
Figure 3:
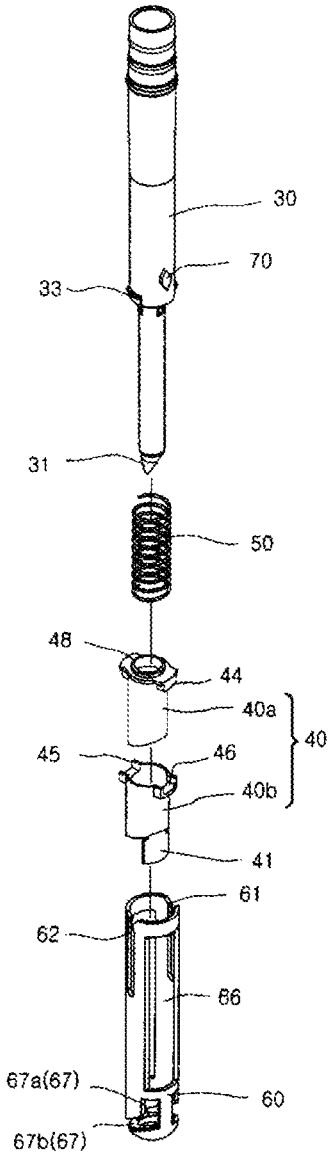
FIG. 3 is an exploded perspective view showing a configuration of the writing instrument according to the present invention.
Figure 4:
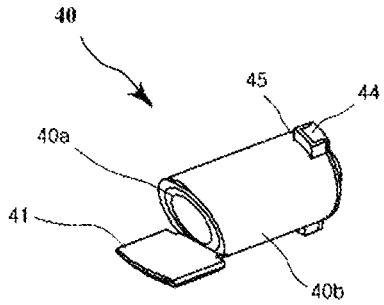
FIG. 4 is a perspective view showing an assembled state of a sealing member of the writing instrument according to the present invention.
Figure 5:
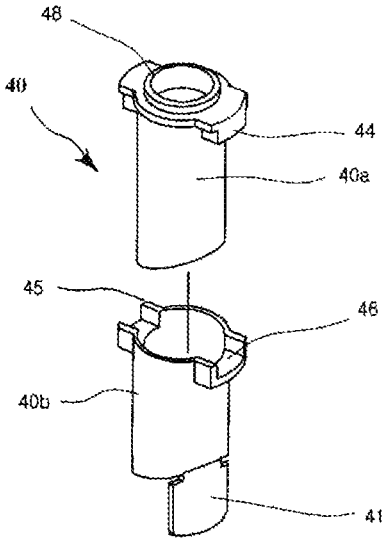
FIG. 5 is a perspective view showing a disassembled state of the sealing member of the writing instrument according to the present invention.
Figure 6:
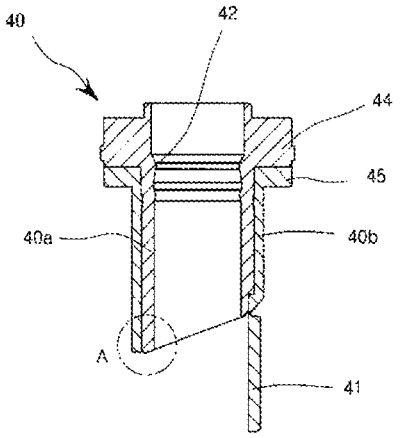
FIG. 6 is a sectional view showing the assembled state of the sealing member of the writing instrument according to the present invention.
Figure 7:
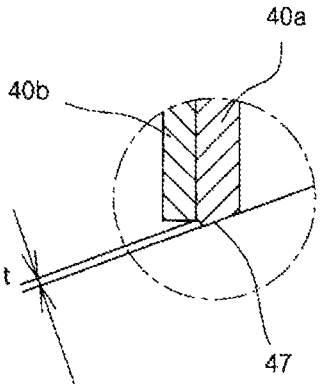
FIG. 7 is an enlarged sectional view of portion A in FIG. 6.

Hereinafter, a preferred embodiment of the present invention will be described in detail with reference to the accompanying drawings.

As illustrated in the figures, a slide-type writing instrument having a drying-prevention device according to the present invention is to enable a pen tip of a writing instrument using highly-volatile ink, for example, a highlighter, a marker, a magic marker, a plus pen or the like, to protrude to the outside only in use, and to be hermetically accommodated in a pen housing of the writing instrument in non-use, thereby preventing evaporation of the ink and drying of the pen tip. The present invention further improves a sealing member of the slide-type writing instrument while employing existing other components themselves except for the sealing member.

In the slide-type writing instrument, a pen housing 10 is formed in the shape of a hollow tube, an ink holder 30 and a sealing member 40 having a drying-prevention function are accommodated in the pen housing, and a button clip part 20 is provided outside of the pen housing.

The pen housing 10 has a pen tip-passing hole 11 formed at a leading end thereof, and a pen tip 31 of the ink holder 30 may be exposed to the outside through the pen tip-passing hole.

An ink injection-type ink holder that can be repeatedly used by injecting ink thereinto or an ink exchange-type ink holder may be employed as the ink holder 30.

Further, the pen housing 10 has the button clip part 20 provided at an upper portion outside of the pen housing, wherein a lock/unlock device for allowing the ink holder 30 to be kept in a forward movement state and/or a backward movement state may be activated by a click operation of the button clip part 20.

In addition, a lock mechanism that is switched to a locked state by pressing a knob 32 of the ink holder 30, which is exposed beyond an upper end of the pen housing 10, once and to an unlocked state by subsequently pressing the knob again may be provided. This lock mechanism has been already known in the art.

The pen tip 31 is coupled to a leading end of the ink holder 30 accommodated in the pen housing 10, and the knob 32 is detachably provided at the other end of the ink holder such that an interior of the pen housing may be filled with ink or ink may be exchanged.

The sealing member 40 is installed at the leading end of the ink holder 30, wherein the pen tip 31 may come in or out via this sealing member. The sealing member 40 has a sealing function for preventing drying of ink in a state where the pen tip 31 is accommodated in the pen housing in non-use.

A cover 41 made of a synthetic resin material is hingedly connected to a leading end of the sealing member 40, and the cover 41 is maintained in a state where the cover is opened in parallel with a central axis of a body of the writing instrument so as not to hinder the pen tip 31 from coming in or out in a natural state.

The cover 41 is fitted into a cam slit 67 of a guide member 60 so that a sealing operation of the cover is controlled by forward and backward operations of the guide member 60.

The guide member 60 is made of a synthetic resin material and formed in a hollow cylindrical shape, and is provided between the sealing member 40 and the pen housing 10.

Accordingly, when the ink holder 30 is moved forward or backward in a state where the sealing member 40 is accommodated in the guide member 60, the guide member 60 is simultaneously moved to guide the cover 41 of the sealing member 40 along the cam slit 67 and thereby to guide an opening or closing operation of the cover 41.

Further, the guide member 60 has engagement parts 61 and a movement slit 62 which are provided longitudinally on a side of the guide member by means of cutting, and an operating hole 65 is provided at a leading end of the guide member so that the pen tip 31 may be moved therethrough.

The ink holder 30 has a cam protrusion 70 integrally formed therewith and protruding therefrom. The cam protrusion causes the guide member 60 to be moved while being in contact with the engagement parts 61 of the guide member 60 and moves along the movement slit 62.

Therefore, in response to forward or rearward operations of the ink holder 30 and the guide member 60 in a state where the pen tip 31 is accommodated, the cover 41 hingedly connected to the leading end of the sealing member is opened, so that the pen tip 31 may come in or out.

Figure 10:
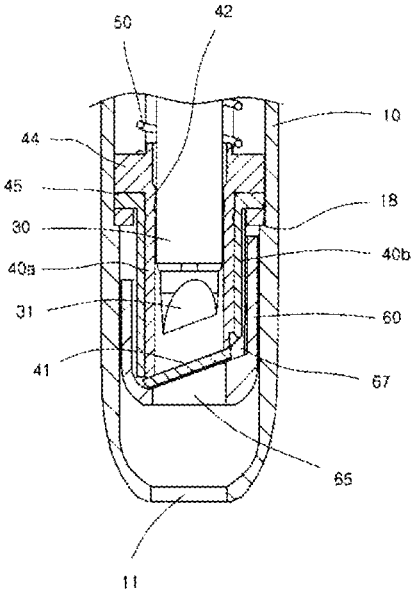
FIG. 10 is an enlarged sectional, partial view showing a state where the pen tip of the writing instrument is stored in the pen housing and maintained in the airtight condition.
Figure 11:
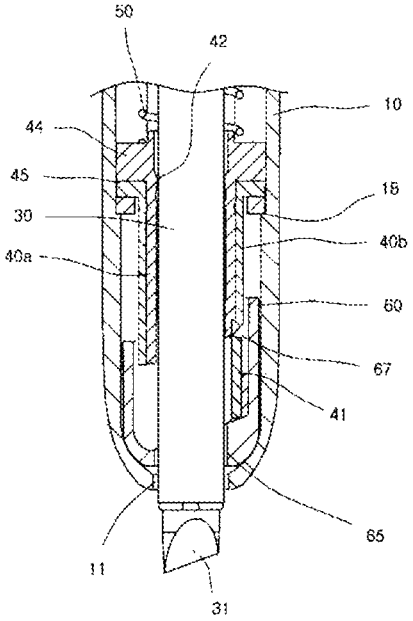
FIG. 11 is an enlarged sectional, partial view showing a state where the pen tip of the writing instrument is exposed.

A spring 50 is elastically provided between a spring-fixing ring 48 of the sealing member 40 and the ink holder 30. Therefore, when the cover 41 of the sealing member 40 is closed again in a state where the cover 41 has been opened, the cam slit 67 restrains the position of the cover 41 by a retreat of the guide member 60, so that the cover is pulled and closed to enable airtightness around the pen tip 31 to be maintained, as shown in FIG. 10.

At this time, the cover 41 of which position is controlled in the cam slit 67 is elastically supported by an elastic force of the spring 50 provided between the spring-fixing ring 48 and the ink holder 30, such that the cover 41 can be maintained to be in close contact with the leading end of the sealing member 40.

Figure 8:
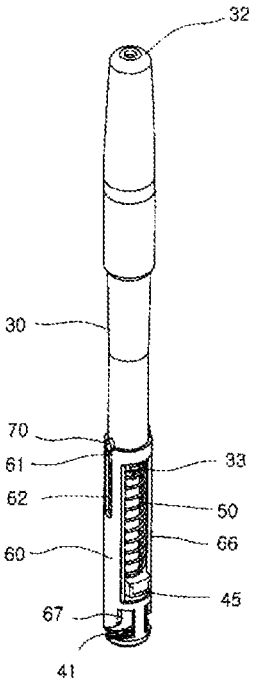
FIG. 8 is a perspective view showing an interior of the pen housing in a state where the pen tip of the writing instrument is stored therein and maintained in the airtight condition.
Figure 9:
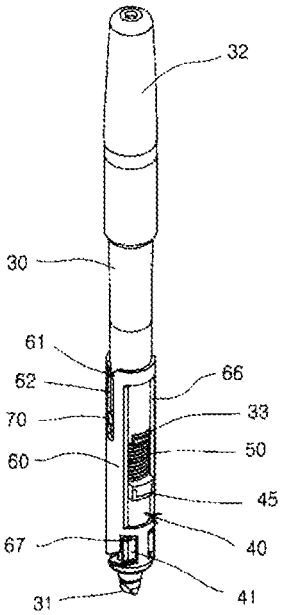
FIG. 9 is a perspective view showing the interior of the pen housing in a state where the pen tip of the writing instrument is exposed to the outside.

Further, the elongated movement slit 62 is longitudinally formed on one side or each of both sides of the guide member 60 as shown in FIGS. 8 and 9. The engagement parts 61 are formed at an entrance of the movement slit 62 to protrude inwardly from both sides to a center of the movement slit 62 in a manner of narrowing a passage of the movement slit 62.

The cam protrusion 70 is formed integrally with and protrudingly from the ink holder 30 at a location where the cam protrusion can be brought into contact with the engagement parts 61. In carried and stored states of the writing instrument where the writing instrument is not in use while the ink holder 30 is accommodated in the pen housing 10, the pen tip 31 has been retreated by the elastic force of the spring 50 to a state where the pen tip is covered with the cover 41 and maintained in an airtight condition within the sealing member 40 (FIG. 10).

The present invention further improves the sealing member 40.

FIGS. 4 to 7 exemplarily illustrate the sealing member 40 of the writing instrument according to the present invention.

The sealing member 40 includes an inner soft tube 40*a* and an outer hard tube 40*b* fitted over the soft tube 40*a* to externally surround the soft tube 40*b*, and these tubes are coupled to each other to form a dual cross-section structure.

The soft tube 40*a* is formed of a soft material and in the shape of a hollow tube, and protrusions 44 are formed at an upper end of the soft tube so as to protrude outward in opposite directions. The hard tube 40*b* is formed of a hard material and in the shape of a hollow tube. The hard tube 40*b* externally surrounds the soft tube 40*a* while being located outside the soft tube 40*a*. In addition, fixing caps 45 are formed on both outer sides of an upper end of the hard tube 40*b*. A flexible rubber material is preferably employed as the soft material for the soft tube 40*a*, and a plastic material which is relatively harder than the material of the soft tube 40*a* is preferably employed as the material for the hard tube 40*b*.

The soft tube 40*a* and the hard tube 40*b* are coupled to each other to form a dual cross-section structure, and a lower end of the soft tube 40*a* further extends than a lower end of the hard tube 40*b* by a protruding height t so that a portion of the lower end of the soft tube 40*a*, which is circumferentially defined by the protruding height t, forms a closed ring-shaped portion 47.

Since the closed ring-shaped portion 47 is made of the soft material, contact of the ring-shaped portion 47 with the cover 41 made of the hard material causes the cover 41 to press the closed ring-shaped portion 47, thereby further enhancing airtightness.

In addition, it is preferable that the soft tube 40*a* is made of a soft rubber material, an inner circumference portion of the soft tube 40*a* is formed with a sealing portion 42 which protrudes inward and is to be brought into close contact with an outer circumference portion of the ink holder 30, and the protrusions 44 are formed at an upper end of an outer surface of the soft tube so as to protrude outward in the opposite directions.

Furthermore, the protrusions 44 of the soft tube 40*a* are interference-fitted into and forcibly coupled to receiving recesses 46 which are concavely formed in the fixing cap 45 of the hard tube 40*b*, thereby achieving assembly of the sealing member 40. This coupling method is different from that disclosed in Korean Patent No. 10-1455958 owned by the present inventor in that the protrusions 44 of the soft tube 40*a* are pressed in a vertical direction into and coupled to the receiving recesses 46 of the hard tube 40*b*. The present invention is advantageous in that work efficiency is very high since the sealing member 40 can be easily assembled when an operator simply pushes and presses the soft tube 40*a* into the hard tube 40*b*. On the contrary, as for Korean Patent No. 10-1455958 owned by the present inventor, upon assembly of the sealing member, there is a disadvantage in that the working efficiency is very low since the protrusion should be aligned in front of the receiving recess and then rotated and pushed into the receiving recess.

In the present invention, dimensions of an outer diameter of the soft tube 40*a* and an inner diameter of the hard tube 40*b* are designed such that it is possible to maintain an integrated feeling of these tubes in an assembled state without being loosened.

Moreover, in the present invention, when the soft tube 40*a* and the hard tube 40*b* are manufactured in consideration of their coupling, the dimension of the receiving recess 46 for receiving the protrusion 44 is designed in an interference-fit tolerance range to prevent separation of the soft tube 40*a* and the hard tube 40*b* due to repeated uses or an impact during use. At this time, if the left protrusion 44 and the right protrusion 44 are formed to have different dimensions and the left receiving recess 46 and the right receiving recess 46 into which the protrusions are interference-fitted, respectively, are formed to have different dimensions, the left protrusion and the left receiving recess are coupled to each other and the right protrusion and the right receiving recess are coupled to each other, whereby there is an advantage in that a coupling work can be more easily performed. For example, if the left protrusion and the left receiving recess are formed to be relatively small, and the right protrusion and the right receiving recess are formed to be relatively large, the right protrusion cannot be fitted into the left receiving recess. Thus, a worker can rapidly align the left protrusion with the left receiving recess and simultaneously couple the right protrusion with the right receiving recess in an accurate manner.

At this time, since the soft tube 40*a* and the hard tube 40*b* are configured such that the lower end of the soft tube 40*a* further extends beyond the lower end of the hard tube 40*b* by the protruding height t to form the closed ring-shaped portion 47 in a state where the soft tube 40*a* is inserted into and assembled with the hard tube 40*b*, the cover 41 provided at the lower end of the hard tube 40*b* is to be brought into close contact with the closed ring-shaped portion 47. Here, the protruding height t is preferably about 0.2 mm.

As such, since the hard cover 41 integrally formed with the hard tube 40*b* is in contact with the closed ring-shaped portion 47 made of the soft material while being pressed more strongly against the closed ring-shaped portion 47, the sealing member 40 can keep a sealed state more completely. This sealed state could not be achieved by the conventional configuration disclosed in Korean Patent No. 10-1455958.

Further, even when the hard cover 41 and the closed ring-shaped portion 47 made of the soft material are repeatedly contacted with each other, a gap is not generated and there is no concern about wear or deformation. Therefore, the present invention is advantageous in that it is possible to greatly prolong the useful life of the sealing member in terms of the sealing function.

It is preferable that a plurality of sealing portions 42 are formed to protrude within the soft tube 40*a* so as to achieve close contact with an outer circumference portion of the ink holder 30.

Next, the operation of the writing instrument according to the present invention will be described below. FIGS. 8 to 13 exemplarily illustrate the operation of the writing instrument according to the present invention.

When the writing instrument is intended to be used while exposing the pen tip 31 out of the leading end of the pen housing 10, the knob 32 is clicked to advance the ink holder 30 together with the sealing member 40. The lock mechanism is formed inside the pen housing 10 such that the locked and unlocked states of the lock mechanism are repeated by the clicks of the knob 32.

Figure 12:
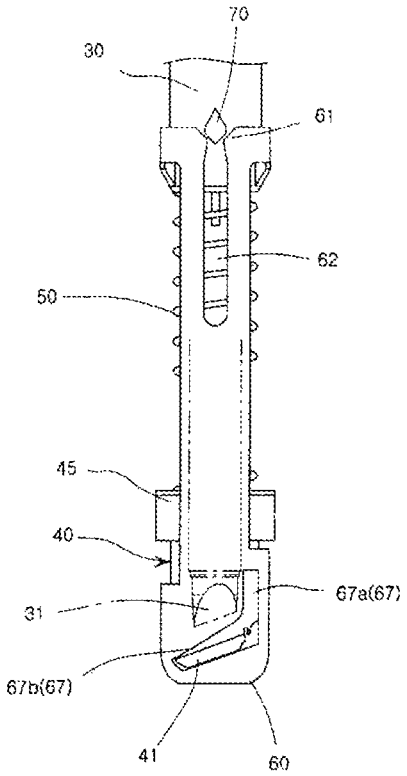
FIG. 12 is a front view of a main portion of the writing instrument, showing a state where a cam protrusion formed on an ink holder is brought into contact with an engagement part of a guide member and then pushed to be moved.

When the knob 32 is deeply clicked to expose the pen tip 31, the cam protrusion 70 protruding externally from the ink holder 30 is brought into contact with the engagement parts 61 of the guide member 60 as shown in FIG. 12 and then is maximally pushed and moved to such an extent that the guide member 60 can be moved, i.e., to a position where the guide member 60 is in contact with an inner side of the leading end of the pen housing 10.

Furthermore, since the fixing cap 45 formed in the sealing member 40 is caught on a stepped portion 18 formed within the pen housing 10, the body of the sealing member 40 is not moved, whereas the cover 41 hingedly connected to the leading end of the sealing member 40 is opened or closed according to the position of the cam slit 67 of the guide member 60.

The cam slit 67 is formed to include a linear section 67*a* parallel to a movement direction of the ink holder 30, and an inclined section 67*b* extending from the linear section 67*a* and causing the cover 41 to be pressed and to be in close contact with the leading end of the sealing member 40.

Figure 13:
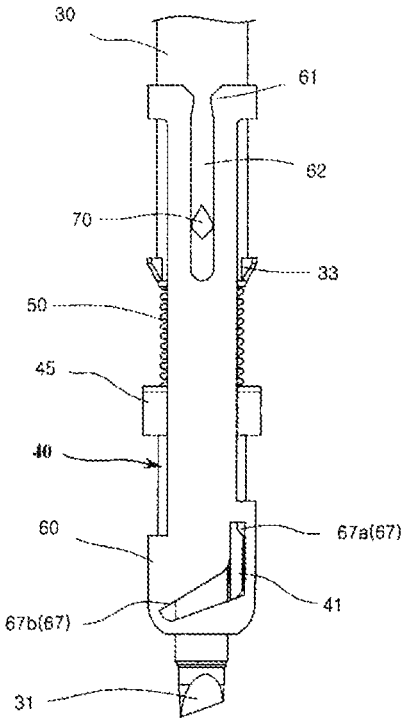
FIG. 13 is a front view of the main portion of the writing instrument, showing a state where the cam protrusion formed on the ink holder has entered a movement slit of the guide member and is then moved.

Therefore, when the guide member 60 is moved to a position where the guide member is in contact with the inner side of the leading end of the pen housing 10 and thus is no longer movable, the cover 41 is opened at the leading end of the sealing member 40 as a result of the movement of the cover from the position of the inclined section 67*b* of the cam slit 67 to the position of the linear section 67*a* (see FIG. 13).

At this time, a space between the engagement parts 61 with which the cam protrusion 70 has been in contact is widened by self-elasticity in response to the advancing movement of the ink holder 30 and the cam protrusion 70 then enters the movement slit 62. Accordingly, the pen tip 31 and the ink holder 30 are continuously further advanced so that the pen tip 31 may be exposed and then used for writing (see FIGS. 2, 9, 11 and 13).

Moreover, when the pen tip 31 is intended to be accommodated in the pen housing 10 and to be kept in the airtight condition, the button clip part 20 or the knob 32 is clicked so that the lock mechanism is operated to be switched to the unlocked state, whereby the ink holder 30 and the pen tip 31 start to be retreated due to the elastic force of the spring 50.

Then, as the guide member 60 is retreated, the cover 41 positioned in the linear section 67*a* of the cam slit 67 is guided to the position of the inclined section 67*b*. In response to a further retreat of the guide member 60, the cover 41 is closed so that the pen tip 31 may be positioned within the sealing member 40 and kept in the airtight condition as shown in FIG. 8.

Here, the cam protrusion 70 is retreated along the movement slit 62 and then widens the space between the engagement parts 61 again at a position where the guide member 60 is caught on the sealing member 40 and can be no longer retreated. Accordingly, the cam protrusion is slightly further retreated and placed in an initial state.

An engaging protuberance 33 is formed protrudingly on the ink holder 30 and an operation slit 66 is formed in the guide member 60 at a position corresponding to the engaging protuberance 33, so that the ink holder 30 and the guide member 60 may be assembled inseparably from each other and moved together upon retreat of the ink holder.

With this operation, the pen tip 31 is exposed to be usable for writing, or is accommodated in the sealing member 40 of the pen housing 10 and kept in the airtight condition to prevent evaporation of the ink or drying of the pen tip 31.

Particularly, the closed ring-shaped portion 47 of the sealing member 40 for performing the function of preventing drying of the pen tip 31 can cause the hard cover 41 to be brought into contact with the soft tube 40*a*, thereby more firmly preventing drying of the pen tip, and also can prevent loss of the sealing function or occurrence of a failure caused by repeated uses, thereby greatly enhancing the reliability and durability of the product.

According to the present invention, there is an advantage in that since the cover made of a hard material presses the closed ring-shaped portion made of a soft material, airtightness achieved by the sealing member for performing prevention of drying of the pen tip is further improved.

In addition, the present invention has an advantage in that since it is possible to prevent loss of the sealing function or occurrence of a failure caused by repeated uses, the reliability and durability of the product can be greatly improved.

The present invention is not limited by the aforementioned embodiment and the accompanying drawings, and it will be apparent to those skilled in the art that various substitutions, changes and modifications may be made without departing from the spirit and scope of the invention.

What is claimed is:

1. A slide-type writing instrument having a drying-prevention device, comprising:

a pen housing (10) formed in a hollow cylindrical shape and having a pen tip-passing hole (11) formed at a leading end of the pen housing and a button clip part (20) at an upper end of the pen housing;

an ink holder (30) disposed in the pen housing (10) and containing ink therein;

a sealing member (40) comprising a cover (41) configured to open or close the pen tip-passing hole (11) in response to a forward or rearward movement of the ink holder (30) so that a pen tip (31) may come in and out through the pen tip-passing hole, and a fixing cap (45) configured to be caught on a stepped portion (18) formed on an inner side of the pen housing (10);

a spring (50) configured to elastically support the sealing member (40) and the ink holder (30);

a guide member (60) made of a synthetic resin and disposed between the sealing member (40) and the pen housing (10), wherein when the ink holder (30) is moved forward or rearward, the guide member (60) guides the cover (41) of the sealing member (40) into a state where the cover is fitted into a cam slit (67) of the guide member, so as to guide an opening or closing operation of the cover (41); and a cam protrusion (70) formed on the ink holder (30) and configured to move the guide member (60) while being in contact with engagement parts (61) of the guide member (60), wherein the sealing member (40) comprises an inner soft tube (40*a*) formed of a soft material and in the shape of a hollow tube, and an outer hard tube (40*b*) formed of a hard material and in the shape of a hollow tube and externally surrounding the soft tube (40*a*); and wherein the soft tube (40*a*) and the hard tube (40*b*) are coupled to each other to form a dual cross-section structure, and a lower end of the soft tube (40*a*) further extends than a lower end of the hard tube (40*b*) by a protruding height (t) so that a portion of the lower end of the soft tube (40*a*) which is circumferentially defined by the protruding height (t) forms a closed ring-shaped portion (47).

2. The slide-type writing instrument of claim 1, wherein protrusions (44) are formed to protrude at an upper end of an outer surface of the soft tube (40*a*); a fixing cap (45) is formed at an upper end of an outer surface of the soft tube (40*b*) and receiving recesses (46) are formed in the fixing cap (45); and the soft tube (40*a*) and the hard tube (40*b*) are assembled by interference-fitting the protrusions (44) of the soft tube (40*a*) into the receiving recesses (46) of the hard tube (40*b*).

* * * * *